United States Patent [19]

Dawiedczyk

[11] Patent Number: 4,651,350

[45] Date of Patent: Mar. 24, 1987

[54] WORK GLOVE

[75] Inventor: Clarence J. Dawiedczyk, Menasha, Wis.

[73] Assignees: Zwicker Knitting Mills, Appleton; Tempo Glove Company, Milwaukee, both of Wis.

[21] Appl. No.: 777,616

[22] Filed: Sep. 19, 1985

[51] Int. Cl.[4] ..... A41D 19/01; A41D 19/00

[52] U.S. Cl. ..... 2/158; 2/163; 2/161 R

[58] Field of Search ..... 2/158, 159, 161 R, 161 A, 2/163

[56] References Cited

U.S. PATENT DOCUMENTS

| | | | |
|---|---|---|---|
| 709,595 | 9/1902 | Carson | 2/161 R |
| 1,275,837 | 8/1918 | Biggs . | |
| 1,329,996 | 2/1920 | Pacifico | 2/159 |
| 1,337,879 | 4/1920 | Bean . | |
| 1,673,517 | 6/1928 | Kurz | 2/161 R |
| 1,680,592 | 8/1928 | Chiles . | |
| 2,118,463 | 5/1938 | Eden | 2/163 |
| 2,128,796 | 8/1938 | Bohm-Myro | 2/158 |
| 2,274,335 | 2/1942 | Kennedy | 2/158 |
| 2,315,889 | 4/1943 | Wells | 2/158 |
| 2,677,130 | 5/1954 | O'Hayer | 2/158 X |
| 3,098,237 | 7/1963 | Slimovitz | 2/158 X |
| 3,299,441 | 1/1967 | Slimovitz | 2/158 |
| 3,608,093 | 9/1971 | Kirby | 2/161 A |
| 4,131,952 | 1/1979 | Brenning, Jr. | 2/163 |

FOREIGN PATENT DOCUMENTS

| | | | |
|---|---|---|---|
| 975328 | 10/1950 | France | 2/163 |
| 1299091 | 6/1962 | France | 2/161 R |
| 88179 | 4/1958 | Netherlands | 2/158 |
| 219910 | 9/1942 | Switzerland | 2/158 |
| 335837 | 10/1930 | United Kingdom | 2/158 |

*Primary Examiner*—Werner H. Schroeder
*Assistant Examiner*—T. Graveline
*Attorney, Agent, or Firm*—Fred Wiviott

[57] ABSTRACT

A glove has open ended, truncated finger portions and a hole intermediate the ends of the thumb portion to permit the fingers and thumb to extend therethrough and allow the performance of operations requiring dexterity. A half mitten is attached to the back of the glove and may be pivoted over the exposed finger portions. A first pad is secured to the palm portion and has a part extending to the thumb opening and a second pad is secured to the thumb portion and has a flap extending over the thumb opening.

4 Claims, 5 Drawing Figures

WORK GLOVE

BACKGROUND OF THE INVENTION

The invention relates to gloves and more particularly to a combination glove and mitten which permits the wearer's fingertips and thumb to be exposed.

One type of prior art outdoor work glove or mitten permits the wearer to expose his or her fingertips and/or thumb without removing the glove or mitten itself. The wearer may then grasp small objects or performs various tasks requiring some degree of dexterity. For example, U.S. Pat. Nos. 2,274,335 and 3,299,441 disclose mittens having slits in the palm portion which permits the wearer's fingers to be exposed while the thumb remains covered. Another prior art mitten disclosed in U.S. Pat. No. 1,275,837 includes a slit for exposing the fingers while the thumb extends through a hole and is exposed at all times.

Yet another type of prior art mitten is disclosed in U.S. Pat. No. 2,315,889 and British Pat. No. 23,616 of 1915. These mittens have a slit for the simultaneous exposure of the fingers and the thumb, but do not include any protection for the thumb or fingers when in their exposed position.

Other types of prior art gloves or mittens permit exposure of one or a few fingers. For example, U.S. Pat. No. 3,608,093 discloses a glove having a slit for the index finger only and U.S. Pat. No. 1,680,592 shows a glove having slits for both the thumb and index finger. In another example illustrated in U.S. Pat. No. 2,118,463, the thumb and index finger have zippers to permit exposure of these digits. In both examples, however, the remaining fingers remain covered.

SUMMARY OF THE INVENTION

It is an object of the invention to provide a new and improved outdoor work glove.

Another object of the invention is to provide a work glove for outdoor use in which the wearer's fingers and thumb may be exposed simultaneously or the fingers collectively and the thumb separately.

A further object of the invention is to provide a glove which provides protection for the palm when the thumb and/or the fingers are exposed and which protects both when covered.

Yet another object of the invention is to provide a glove which permits the thumb to be exposed wherein the thumb is fully protected when covered.

These and other objects and advantages of the instant invention will become more apparent from the detailed description thereof taken with the accompanying drawings.

In general terms, the invention comprises a glove having the ends of the finger portion exposed and a half mitten secured to the back of the glove and constructed and arranged to be pivoted over the exposed finger portion. An opening intermediate the ends of the thumb portion permit the wearer's thumb to be exposed and a first pad covers the glove's palm portion and a second pad covers the thumb portion and includes a flap extending over the thumb opening.

DETAILED DESCRIPTION OF THE PREFERRED EMBODIMENT

Figure 5:
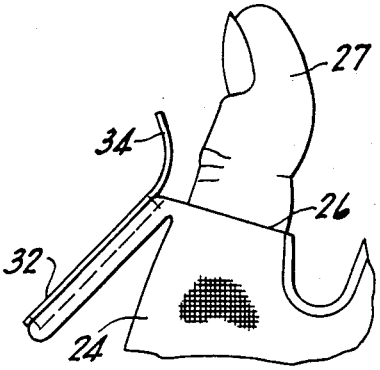
FIG. 5 is a side view of the thumb portion shown in FIG. 4.

The work glove 10 illustrated in the drawings includes a tubular hand section 11 having a palm portion 12 and a back 13. Finger portions 14, 15, 16 and 17 are attached to one end of the tubular section 13 and a cuff 18 is formed to the other. Each of the finger portions 14, 15, 16 and 17 is truncated and open-ended to permit the wearer's fingers 19, 20, 21 and 22 to extend therethrough. A full thumb portion 24 is attached to the palm 12 and at one side thereof for a right-hand glove as illustrated and at the opposite side for a left-hand glove. An elliptical opening 26 is formed intermediate the ends of the thumb portion 24 to permit the wearer's thumb 27 to extend therethrough as shown in FIG. 5.

While the glove 10 may be formed of any suitable material, in the illustrated embodiment it is knit yarn. To provide protection to the wearer's palm and to enhance gripping, a pad 28, of a suitable material, such as leather, is attached to the palm 12 in any manner such as by stitching. The pad 28 extends diagonally across the palm portion 12 and has a projecting part 30 extending along the thumb portion 24 to the opening 26. Affixed to the thumb portion 24 on the opposite side of the opening 26 is a second pad 32 which may also be of any suitable material, such as leather. A flap 34 integral with the pad 32 extends over the opening 26 so that the latter is normally covered.

Figure 1:
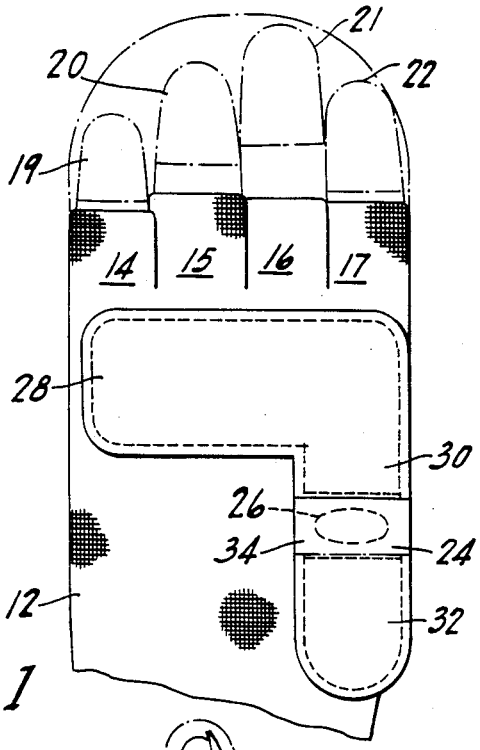
FIG. 1 is a front view of the glove according to the preferred embodiment of the invention.
Figure 2:
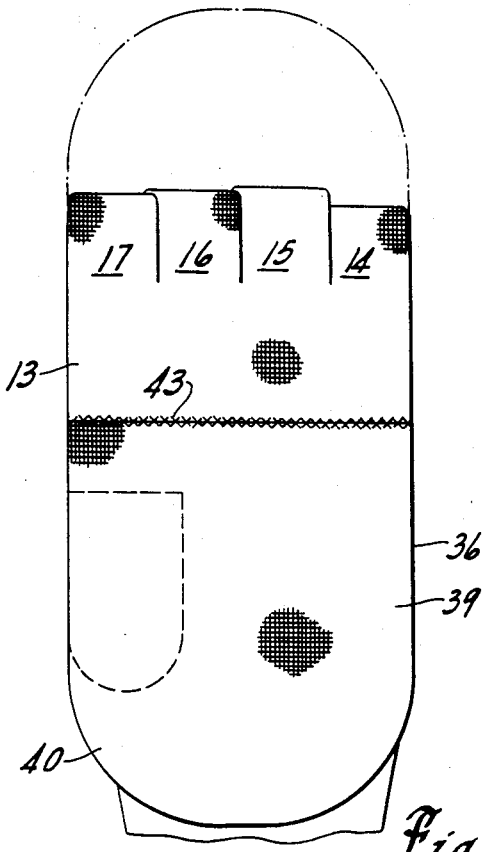
FIG. 2 is a rear view of the glove illustrated in FIG. 1.

A half mitten 36 is attached to the back 12 of the glove 10 and comprises tubular section having a front part 38 and a back part 39. The parts 38 and 39 each have a curved first edge 40 at one end which are suitably attached to each other and linear edges 42 and 43, respectively at the other end which are unattached. The half mitten 36 thereby forms an open-ended pocket. Edge 42 of the half mitten 36 is suitably affixed to the back 13, such as by stitching, and above a line opposite the palm portion 12 and generally perpendicular to th portions 14, 15, 16 and 17. The edge 43 remains unattached. This permits the half mitten 36 to be flipped upwardly and over the exposed fingers 19–22 as shown by broken lines in FIG. 1 and by full lines in FIG. 3.

Figure 3:
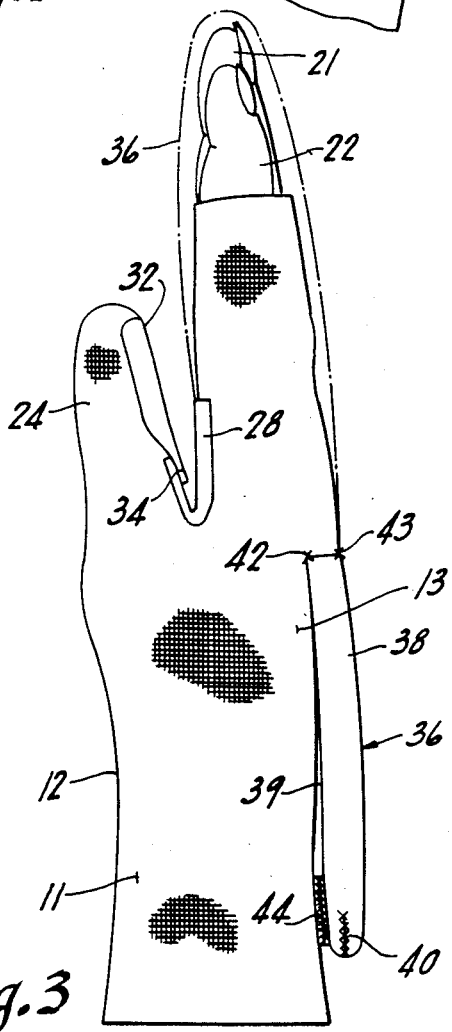
FIG. 3 is a side view of the glove illustrated in FIG. 1.
Figure 4:
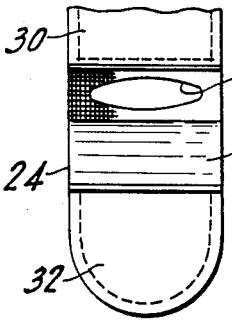
FIG. 4 illustrates the thumb portion of the glove shown in FIG. 1.

In use, the half mitten would be worn in its position shown by broken lines in FIG. 3 with the wearer's thumb and fingers covered for protection against the cold. When it is required that the wearer perform some function requiring use of this fingers, the half glove 36 is flipped back to its position shown by full lines in FIG. 3, thus exposing the wearer's finger-tips. In addition, the wearer's thumb may be extended outwardly of the opening 26 so that it too is exposed for grasping as shown in FIG. 5. Attachment means, such as, Velcro 44 may be provided at the back 39 of half mitten 36 and the back 12 of glove 10 so that the half mitten 36 may be held in position. When the particular task is completed, the wearer's thumb may be withdrawn inwardly through the opening 26 and the half mitten 36 pivoted back over fingertips. It can be seen that in this position the flap 34 covers the opening 26 so that the wearer's thumb is completely protected.

While only a single embodiment of the invention has been illustrated and described, it is not intended to be limited thereby but only by the scope of the appended claims.

I claim:

1. A glove having a palm portion, finger portions and a thumb portion, the finger portions being truncated for exposing the wearer's fingertips, said thumb portion having a first end adjacent said palm portion and a second end remote therefrom, a hole formed intermediate the ends of the thumb portion to permit the wearer's thumb to extend therethrough, a thumb pad having a first part fixed to the exterior of the thumb portion between the hole and the remote end thereof and a second part on the exterior of the thumb portion and extending from the first part over the hole and toward said palm portion, at the area of the hole said second part being unattached to said thumb portion and normally covering the hole, whereby said second part can be pushed away from said opening to permit the wearer's thumb to extend through the opening, and a half mitten attached to the rear of the glove along a line opposite the palm portion, said half mitten defining an open ended pocket which may be pivoted over the wearer's exposed fingertips for protecting the same, said thumb portion extending free of the half mitten when the latter covers the exposed end of the finger portions so that the wearer's fingertips may be covered and uncovered separately from the thumb.

2. The glove set forth in claim 1 wherein there is a second pad covering the glove's palm portion and having a part extending from the palm portion to the first pad and adjacent the thumb opening the second part of the thumb pad extending from across the opening and over the adjacent portion of the second pad.

3. The glove set forth in claim 1 wherein said half mitten has front and rear portions which are attached along a portion of their peripheries and linear periphery portions which are unattached to define an open ended pocket, the linear peripheral portion of the rear portion being attached to the rear of the glove along a line opposite the palm and generally perpendicular to the fingers, the linear peripheral portion of the front portion being unattached to permit the half mitten to be pivoted over the open ends of the finger portions.

4. The glove set forth in claim 3 and including attachment means attached to the rear portion of the half mitten and to the glove for releasably holding the half mitten against the back of the glove.

* * * * *